US006136051A

United States Patent [19]

Forde et al.

[11] Patent Number: 6,136,051

[45] Date of Patent: Oct. 24, 2000

[54] METHOD AND COMPOSITION FOR REDUCTION OF COMBUSTION CHAMBER DEPOSITS

[75] Inventors: Ralph M. Forde, Benicia; Majid R. Ahmadi, Hercules; Richard E. Cherpeck, Cotati, all of Calif.

[73] Assignee: Chevron Chemical Company, San Ramon, Calif.

[21] Appl. No.: 08/676,030

[22] Filed: Jul. 5, 1996

Related U.S. Application Data

[60] Provisional application No. 60/000,935, Jul. 6, 1995.

[51] Int. Cl.[7] ..... C10L 1/22

[52] U.S. Cl. ..... 44/432; 44/347; 44/412

[58] Field of Search ..... 252/373; 44/412, 44/312, 437, 419, 432, 347

[56] References Cited

U.S. PATENT DOCUMENTS

| | | | |
|---|---|---|---|
| 3,223,495 | 12/1965 | Calvino | 44/71 |
| 3,310,492 | 3/1967 | Benoit | 252/51.5 |
| 3,438,757 | 4/1969 | Honnen et al. | 44/58 |
| 3,443,918 | 5/1969 | Kautsky | 44/63 |
| 3,565,804 | 2/1971 | Honnen et al. | 252/50 |
| 3,671,511 | 6/1972 | Honnen et al. | 260/93.7 |
| 3,676,089 | 7/1972 | Morris | 44/62 |
| 3,785,789 | 1/1974 | Honnen et al. | 44/66 |
| 3,864,098 | 2/1975 | Honnen | 44/58 |
| 4,039,300 | 8/1977 | Chloupek | 44/58 |
| 4,325,708 | 4/1982 | Bagnetto | 44/58 |
| 4,877,416 | 10/1989 | Campbell | 44/62 |
| 5,089,028 | 2/1992 | Abramo | 44/347 |
| 5,114,435 | 5/1992 | Abramo | 44/348 |
| 5,393,309 | 2/1995 | Cherpeck | 44/347 |

FOREIGN PATENT DOCUMENTS

| | | |
|---|---|---|
| 0 382 405 | 8/1990 | European Pat. Off. . |
| 1 382 910 | 2/1965 | France . |
| WO 90/02785 | 3/1990 | WIPO . |
| WO 93/06194 | 4/1993 | WIPO . |

*Primary Examiner*—Michael L. Shippen
*Attorney, Agent, or Firm*—Claude J. Caroli

[57] ABSTRACT

A fuel composition has a major portion of hydrocarbons boiling in the gasoline range, at least 1,200 ppm by weight of a detergent, and at least 2,400 ppm by weight of a mineral carrier fluid. The detergent is a hydrocarbyl-substituted amine or polyamine having at least one basic nitrogen. The weight ratio of mineral carrier fluid to detergent of the fuel composition is at least 2:1. Preferably, the detergent is present at a concentration of at least 2,000 ppm by weight, and the weight ratio of mineral carrier fluid to detergent is at least 4:1. Preferably, the detergent is either a polybutene amine or a polybutene succinimide.

10 Claims, 1 Drawing Sheet

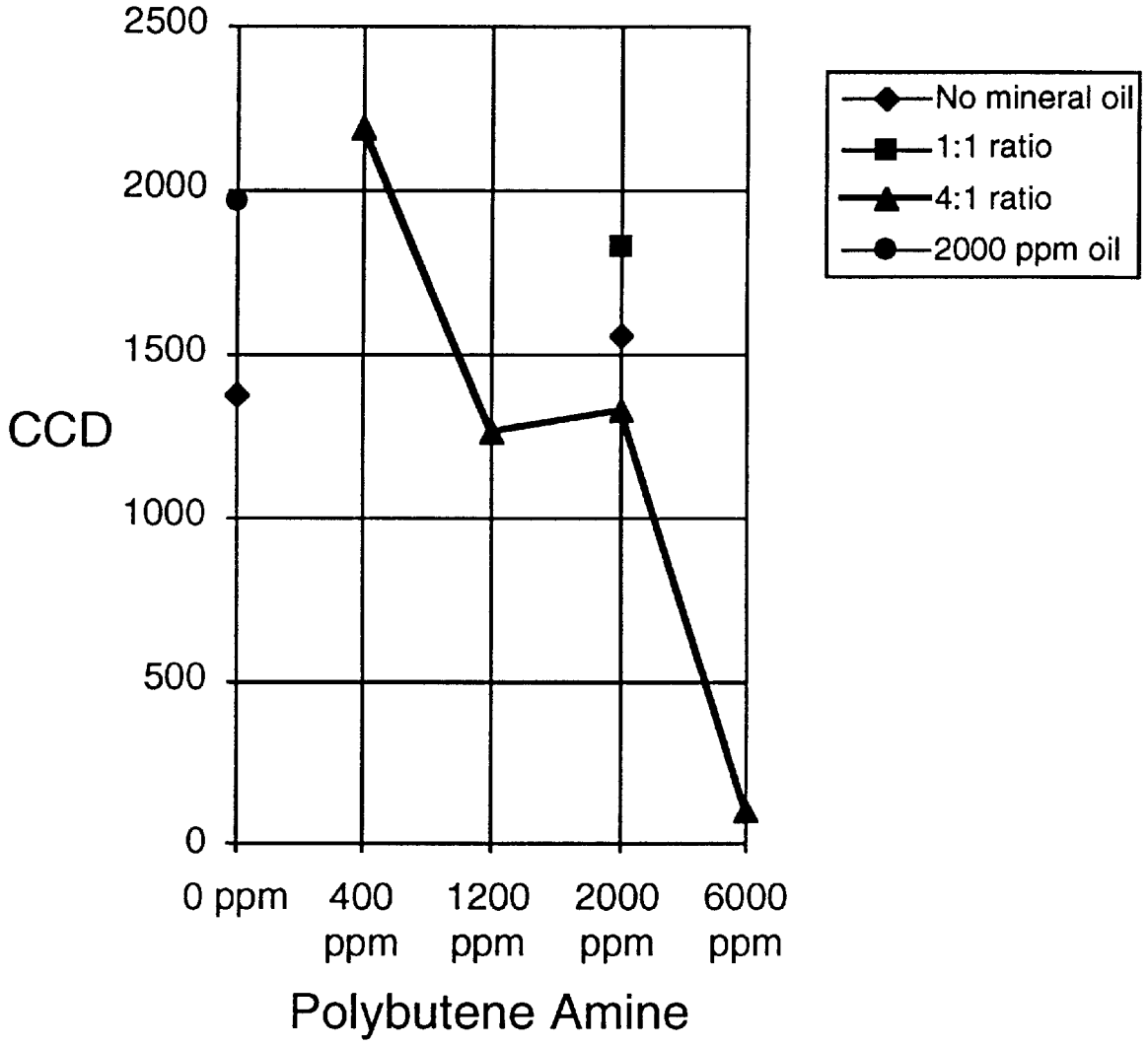
2500
2000
1500
1000
500
0
CCD
0 ppm
400 ppm
1200 ppm
2000 ppm
6000 ppm
Polybutene Amine
No mineral oil
1:1 ratio
4:1 ratio
2000 ppm oil

METHOD AND COMPOSITION FOR REDUCTION OF COMBUSTION CHAMBER DEPOSITS

This application claims priority from U.S. Provisional Application Serial No. 60/000,935, filed Jul. 6, 1995.

The present invention relates to a fuel composition having good control of combustion chamber deposits.

BACKGROUND OF THE INVENTION

It is well known that automobile engines tend to form deposits on the surface of engine components due to oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or deposit control additives to prevent or control such deposits is of considerable importance and numerous such materials are known in the art.

Polybutene fuel additives, such as polybutene amines and polybutene succinimides, are examples of fuel additives well known in the art. They aid in decreasing deposits in intake valves and port fuel injectors of internal combustion engines. However, they have been considered to contribute to, rather than reduce combustion chamber deposits. Because it was widely believed that increasing concentrations of such fuel additives would lead to an increase in combustion chamber deposits, commercial polybutene fuel additive concentrations were typically below 300 ppm. The prior art does not teach that the polybutene amine can actually give better combustion chamber deposit control than the base fuel alone.

U.S. Pat. No. 3,438,757 teaches using a hydrocarbyl-substituted amine with mineral oil. The amine is added at from 100 to 1,000 ppm.

U.S. Pat. No. 3,785,789 teaches using the reaction product of a hydrocarbyl-substituted amine and a coupling agent with mineral oil. From 100 to 4,000 ppm of the reaction product may be present in the fuel. Preferably, from 200 to 800 ppm is used. The only concentration used in the examples is 1,000 ppm.

U.S. Pat. No. 4,877,416 teaches using a hydrocarbyl-substituted amine or polyamine and a poly(oxyalkylene) monool. The amine is added at from 10 to 10,000 ppm (preferably 200 to 1,000 ppm). No example was given of an actual fuel composition, and there was no teaching that the polybutene amine actually gives better combustion chamber deposit control than the base fuel alone.

SUMMARY OF THE INVENTION

The present invention provides a fuel composition having good control of combustion chamber deposits.

We have discovered that high concentrations of the combination of fuel-soluble polybutene amine or polybutene succinimide and mineral carrier fluid in a fuel give better control of combustion chamber deposits than the base fuel without these additives. This is surprising because these additives have an adverse effect on combustion chamber deposit control when used at lower concentrations.

Our fuel composition comprises a major portion of hydrocarbons boiling in the gasoline range; at least 1,200 ppm by weight of a detergent; and at least 2,400 ppm by weight of a mineral carrier fluid, wherein the weight ratio of mineral carrier fluid to detergent is at least 2:1. The detergent is a hydrocarbyl-substituted amine or polyamine that has at least one basic nitrogen, such as a polybutene amine or a polybutene succinimide. Preferably, the detergent is present at a concentration of at least 2,000 ppm by weight, and the weight ratio of mineral carrier fluid to detergent is at least 4:1.

BRIEF DESCRIPTION OF THE DRAWINGS

In order to assist the understanding of this invention, reference will now be made to the appended drawings. The drawings are exemplary only, and should not be construed as limiting the invention.

FIG. 1 shows a plot of combustion chamber deposits in response to the concentration of additives.

DETAILED DESCRIPTION OF THE INVENTION

In its broadest aspect, the present invention involves a fuel composition comprising a major portion of hydrocarbons boiling in the gasoline range; at least 1,200 ppm by weight of a detergent selected from the group consisting of hydrocarbyl-substituted amine or polyamine, wherein the detergent has at least one basic nitrogen; and at least 2,400 ppm by weight of a mineral carrier fluid, wherein the weight ratio of mineral carrier fluid to detergent is at least 2:1.

A. HYDROCARBYL-SUBSTITUTED AMINES OR POLYAMINE

The hydrocarbyl-substituted amines or polyamines employed in this invention are well known and are disclosed in U.S. Pat. Nos. 3,438,757 and 3,394,576. A method for their preparation is found in U.S. Pat. Nos. 3,565,804; 3,671,511; and. U.S. Pat. Nos. 3,438,757; 3,394,576; 3,565,804; 3,671,511; and 5,045,418 are hereby incorporated by reference for all purposes.

The hydrocarbyl-substituted amines employed in this invention are prepared by reacting a hydrocarbyl halide (i.e., chloride) with ammonia or a primary or secondary amine to produce the hydrocarbyl-substituted amine.

The hydrocarbyl-substituted amines and polyamines are high-molecular-weight hydrocarbyl-N-substituted amines or polyamines containing at least one basic nitrogen. The hydrocarbyl group has an average molecular weight in the range of from 450 to 10,000, more usually in the range of about 1,000 to 5,000.

The hydrocarbyl radical may be aliphatic, alicyclic, aromatic, or combinations thereof. The hydrocarbyl groups will normally be branched-chain aliphatic, having zero to two sites of unsaturation, and preferably from zero to one site of ethylene unsaturation. The hydrocarbyl groups are preferably derived from polyolefins, either homopolymers or higher-order polymers, or 1-olefins of from two to six carbon atoms. Ethylene is preferably copolymerized with a higher olefin to insure fuel solubility.

Illustrative polymers include polypropylene, polyisobutylene, poly-1-butene, etc. The polyolefin group will normally have at least one branch per six carbon atoms along the chain, preferably at least one branch per four carbon atoms along the chain. These branched-chain hydrocarbons are readily prepared by the polymerization of olefins of from three to six carbon atoms and preferably from olefins of from three to four carbon atoms.

In preparing the compositions of this invention, rarely will a single compound having a defined structure be employed. With both polymers and petroleum-derived hydrocarbon groups, the composition is a mixture of materials having various structures and molecular weights. Therefore, in referring to molecular weight, average molecular weights are intended. Furthermore, when speaking of a particular hydrocarbon group, it is intended that the group include the mixture that is normally contained within materials that are commercially available. For example, polyisobutylene is known to have a range of molecular weights and may include small amounts of very high molecular-weight materials.

Particularly preferred hydrocarbyl-substituted amines or polyamines are prepared from polyisobutenyl chloride.

The polyamine employed to prepare the hydrocarbyl-substituted polyamine is preferably a polyamine having from two to twelve amine nitrogen atoms and from two to about 40 carbon atoms. The polyamine is reacted with a hydrocarbyl halide (e.g., chloride) to produce the hydrocarbyl-substituted polyamine employed in this invention. The polyamine is so selected to provide at least one basic nitrogen in the hydrocarbyl-substituted polyamine. The polyamine preferably has a carbon-to-nitrogen ratio of from about 1:1 to about 10:1.

The amine portion of the hydrocarbyl-substituted amine may be substituted with substituents selected from hydrogen and hydrocarbyl groups of from one to ten carbon atoms.

The polyamine portion of the hydrocarbyl-substituted polyamine may be substituted with substituents selected from hydrogen, hydrocarbyl groups of from one to ten carbon atoms, acyl groups of from two to ten carbon atoms, and monoketo, monohydroxy, mononitro, monocyano, lower alkyl and lower alkoxy derivatives of the above hydrocarbyl groups and acyl groups. "Lower," as used in terms like lower alkyl or lower alkoxy, means a group containing from one to six carbon atoms.

At least one of the nitrogens in the hydrocarbyl-substituted amine or polyamine is a basic nitrogen atom, (i.e., one tetratable by a strong acid).

Hydrocarbyl, as used in describing the amine or polyamine substituents of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, (i.e., ethylenic and acetylenic, particularly acetylenic unsaturation). The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc.; alkenyls such as propenyl, isobutenyl, hexenyl, octenyl, etc.; hydroxy alkyls, such as 2-hydroxyethyl, 3-hydroxypropyl, hydroxyisopropyl, 4-hyroxybutyl, etc.; ketoalkyls, such as 2-ketopropyl, 6-ketooctyl, etc.; alkoxy and lower alkenoxy alkyls, such as ethoxyethyl, ethoxypropyl, propoxyethyl, propoxypropyl, 2-(2-ethoxyethoxy)ethyl, 2(2(2-ethoxyethoxy)ethoxy)ethyl, 3,6,9,12-tetraoxytetradecyl, 2-(2-ethoxyethoxy)hexyl, etc.

Typical amines useful in preparing the hydrocarbyl-substituted amines employed in this invention include methylamine, dimethylamine, ethylamine, diethylamine, n-propylamine, di-n-propylamine, etc. Such amines are either commercially available or are prepared by art-recognized procedures.

The polyamine component also may contain heterocyclic polyamines, heterocyclic substituted amines, and substituted heterocyclic compounds, wherein the heterocycle comprises one or more 5–6 membered rings containing oxygen and/or nitrogen. Such heterocycles may be saturated or unsaturated, and substituted with groups selected from the aforementioned hydrogen, hydrocarbyl groups, acyl groups, and monoketo, monohydroxy, mononitro, monocyano, lower alkyl and lower alkoxy derivatives of the above hydrocarbyl groups and acyl groups. The heterocycles are exemplified by piperazines, such as 2-methylpiperazine, 1,2-bis (N-piperazinyl)ethane, and N,N'-bis(N-piperazinyl) piperazine, 2-methylimidazoline, 3-aminopiperidine, 2-aminopyridine, 2(β-aminoethyl)-3-pyrroline, 3-aminopyrrolidine, N-(3-aminopropyl)morpholine, etc. Among the heterocyclic compounds, the piperazines are preferred.

Typical polyamines that can be used to form the compounds of this invention include the following: ethylene diamine, 1,2-propylene diamine, 1,3-propylene diamine, diethylene triamine, triethylene tetramine, hexamethylene diamine, tetraethylene pentamine, methylaminopropylene diamine, N(β-aminoethyl)piperazine, N,N'di(β-aminoethyl) piperazine, N,N'-di(β-aminoethyl)imidazolidone-2, N-(β-cyanoethyl)ethane-1,2-diamine, 1,3,6,9-tetraaminooctadecane, 1,3,6-triamino-9oxadecane, N-methyl-1,2-propanediamine, 2-(2-aminoethylamino)-ethanol.

Another group of suitable polyamines is the propyleneamines, (bisaminopropylethylenediamines). Propyleneamines are prepared by the reaction of acrylonitrile with an ethyleneamine, for example, an ethyleneamine having the formula, $H_2N(CH_2CH_2NH)_zH$ wherein Z is an integer from one to five, followed by hydrogenation of the resultant intermediate. Thus, the product prepared from ethylene diamine and acrylonitrile would be $H_2N(CH_2)_3NH(CH_2)_2NH(CH_2)_3NH_2$.

In many instances the polyamine used as a reactant in the production of hydrocarbyl-substituted polyamine of the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the hydrocarbyl-substituted polyamines for use in this invention, where the various nitrogen atoms of the polyamine are not geometrically equivalent, several substitutional isomers are possible and are encompassed within the final product. Methods of preparation of polyamines and their reactions are detailed in Sidgewick's "The Organic Chemistry of Nitrogen" Clarendon Press, Oxford, 1966; Noller's "Chemistry of Organic Compounds", Saunders, Philadelphia, 2nd Ed. 1957; and Kirk-Othmer's "Encyclopedia of Chemical Technology", 2nd Ed., especially Volumes 2, pp. 99–116.

The preferred hydrocarbyl-substituted polyalkylene polyamines for use in this invention may be represented by the formula $$R_1NH—(R_2—NH)_aH$$

wherein $R_1$ is hydrocarbyl having an average molecular weight of from about 450 to about 10,000; $R_2$ is alkylene of from two to six carbon atoms; and a is an integer of from zero to ten.

Preferably, $R_1$ is hydrocarbyl having an average molecular weight of from about 1,000 to about 10,000. Preferably, $R_2$ is alkylene of from two to three carbon atoms and a is preferably an integer of from one to six.

B. THE CARRIER FLUID

A nonvolatile lubricating mineral oil, e.g., petroleum spray oil, particularly a refined naphthenic lubricating oil having a viscosity at 100° F. of 1,000 to 2,000 SUS, is a suitable additive for the gasoline compositions used with the detergents of this invention and its use is preferred. These oils are believed to act as a carrier for the detergent and to assist in removing and preventing deposits. They are employed in amounts of at least 2,400 ppm by weight based on the final gasoline composition.

C. THE FUEL COMPOSITION

The fuel employed in the fuel compositions of the instant invention is generally a hydrocarbon distillate fuel boiling in the gasoline range. The hydrocarbyl-substituted amine or polyamine, as well as the mineral carrier fluid, are generally added directly to the fuel at the desired concentrations.

The hydrocarbyl-substituted amine or polyamine is added at a concentration of at least 1,200 ppm by weight of the fuel, although preferably, at a concentration of at least 2,000 ppm by weight. The hydrocarbyl-substituted amine or polyamine is added at a high concentration because we have found that a high concentration of hydrocarbyl-substituted amine or polyamine is needed in order not to have a detrimental effect on combustion chamber deposits.

The mineral carrier fluid is added to form a concentration of at least 2,400 ppm by weight of the fuel composition, wherein the weight ratio of mineral carrier fluid to detergent is at least 2:1. The mineral carrier fluid is added at this high concentration in order to reduce combustion chamber deposits. Preferably, the weight ratio of mineral carrier fluid to detergent is at least 4:1.

In gasoline fuels, other fuel additives may also be included, such as anti-knock agents, (e.g., methylcyclopentadienyl manganese tricarbonyl, tetramethyl or tetraethyl lead), or other dispersants or detergents, such as various substituted succinimides, amines, etc. Also included may be lead scavengers, such as aryl halides, (e.g., dichlorobenzene) or alkyl halides, (e.g., ethylene dibromide). Additionally, antioxidants, metal deactivators, and demulsifiers may be present.

EXAMPLES

The invention will be further illustrated by following examples, which set forth particularly advantageous method embodiments. While the examples are provided to illustrate the present invention, they are not intended to limit it.

Example 1

An engine test was carried out using an unadditized test gasoline A with properties shown in Table 1:

TABLE 1

| Test Gasoline | |
|---|---|
| T 90, ° F. | 356 |
| Sulfur, ppmw | 120 |
| Aromatics, vol % | 48 |

TABLE 1-continued

| Test Gasoline | |
|---|---|
| Olefins, vol % | 10 |
| Gum, washed, mg/100 mL | 3 |

The test engine was a Labeco CLR engine with the specifications shown in Table 2.

TABLE 2

| Test Engine Specifications | |
|---|---|
| Displacement, cu. in. | 42.5 |
| Compression Ratio | 8:1 |

The engine was run in the cycle shown in Table 3 with the in a Labeco CLR engine.

TABLE 3

| Engine Test Cycle | | |
|---|---|---|
| Minutes | RPM | MAP, "Hg |
| 2 | 900 | 15 |
| 1 | 2000 | 7 |
| 2 | 2000 | 12.9 |
| 2 | 2000 | 15 |
| 1 | 2000 | 7 |
| 2 | 2000 | 12.9 |
| 3 | 900 | 15 |
| 1 | 2000 | 7 |
| 1 | 2000 | 12.9 |
| 1 | 2500 | 8.9 |
| 2 | 2500 | 15 |
| 2 | 2000 | 16 |
| 2 | 2000 | 12 |
| Coolant temp., ° F. - 140 | | |
| Intake Air temp., ° F. - 130 | | |

At the end of each test run, the engine head was removed and the combustion chamber deposits on the cylinder head and piston top were scraped off and weighed. The results are shown in Table 4.

Example 2

A fuel composition B was prepared using test gasoline A with the following additive:

1. 400 ppm by wt. of a hydrocarbyl amine having a 1300 MW polyisobutenyl moiety and an ethylene diamine moiety, similar to that disclosed in U.S. Pat. No. 5,405,418.
2. 1600 ppm by wt. of a mineral carrier oil consisting of a 325 neutral oil.

The same experiment as in Example 1 was carried out using this fuel composition, and the results are shown in Table 4.

Example 3

A fuel composition C was prepared using test gasoline A with the following additive:

1. 1200 ppm by wt. of the hydrocarbyl amine from Example 2.
2. 2400 ppm by wt. of a mineral carrier oil consisting of a 325 neutral oil.

The same experiment as in Example 1 was carried out using this fuel composition, and the results are shown in Table 4.

Example 4

A fuel composition D was prepared using test gasoline A with the following additive:

1. 2000 ppm by wt. of the hydrocarbyl amine from Example 2.
2. 8000 ppm by wt. of a mineral carrier oil consisting of a 325 neutral oil.

The same experiment as in Example 1 was carried out using this fuel composition, and the results are shown in Table 4.

Example 9

A fuel composition I was prepared using test gasoline A with the following additive:

1. 24000 ppm by wt. of a mineral carrier oil consisting of a 325 neutral oil.

The same experiment as in Example 1 was carried out using this fuel composition, and the results are shown in Table 4.

TABLE 4

| FUEL | A | B | C | D | E | F | G | H | I |
|---|---|---|---|---|---|---|---|---|---|
| polybutene amine | 0 | 400 | 1200 | 2000 | 6000 | 2000 | 2000 | 0 | 0 |
| mineral oil | 0 | 1600 | 4800 | 8000 | 24000 | 0 | 2000 | 2000 | 24000 |
| carrier oil ratio | | 4 | 4 | 4 | 4 | 0 | 1 | | |
| ave. CCD. mg/cyl | 1375 | 2187 | 1256.5 | 1323.5 | 99 | 1559 | 1829 | 1965.6 | 1735 |

Example 5

A fuel composition E was prepared using test gasoline A with the following additive:

1. 6000 ppm by wt. of the hydrocarbyl amine from Example 2.
2. 24000 ppm by wt. of a mineral carrier oil consisting of a 325 neutral oil.

The same experiment as in Example 1 was carried out using this fuel composition, and the results are shown in Table 4.

Example 6

A fuel composition F was prepared using test gasoline A with the following additive:

1. 2000 ppm by wt. of the hydrocarbyl amine from Example 2.

The same experiment as in Example 1 was carried out using this fuel composition, and the results are shown in Table 4.

Example 7

A fuel composition G was prepared using test gasoline A with the following additive:

1. 2000 ppm by wt. of the hydrocarbyl amine from Example 2.
2. 2000 ppm by wt. of a mineral carrier oil consisting of a 325 neutral oil.

The same experiment as in Example 1 was carried out using this fuel composition, and the results are shown in Table 4.

Example 8

A fuel composition H was prepared using test gasoline A with the following additive:

1. 2000 ppm by wt. of a mineral carrier oil consisting of a 325 neutral oil.

The same experiment as in Example 1 was carried out using this fuel composition, and the results are shown in Table 4.

While the present invention has been described with reference to specific embodiments, this application is intended to cover those various changes and substitutions that may be made by those skilled in the art without departing from the spirit and scope of the appended claims.

What is claimed is:

1. A fuel composition comprising:

(a) a major portion of hydrocarbons boiling in the gasoline range;

(b) at least 1,200 ppm by weigh of a hydrocarbyl-substituted polyamine detergent of the formula:

$$R_1NH—(R_2NH)_aH$$

wherein $R_1$ is a polyisobutenyl group having an average molecular weight of from about 450 to about 10,000; $R_2$ is alkylene of from two to six carbon atoms; and a is an integer of from zero to ten; and (c) at least 4,800 ppm by weight of a mineral carrier fluid, wherein the weight ratio of mineral carrier fluid to detergent is at least 4:1.

2. The fuel composition according to claim 1, wherein the detergent is present at a concentration of at least 2,000 ppm by weight.

3. The fuel composition according to claim 1, wherein $R_1$ is a hydrocarbyl group having an average molecular weight of from about 1,000 to 10,000.

4. The fuel composition according to claim 1, wherein $R_2$ is alkylene of from two to three carbon atoms.

5. The fuel composition according to claim 1, wherein a is an integer of from one to six.

6. A method for controlling combustion chamber deposits in an internal combustion engine which comprises operating the engine with a fuel composition comprising:

(a) a major portion of hydrocarbons boiling in the gasoline range;

(b) at least 1,200 ppm by weigh of a hydrocarbyl-substituted polyamine detergent of the formula:

$$R_1NH—(R_2NH)_aH$$

wherein $R_1$ is a polyisobutenyl group having an average molecular weight of from about 450 to about 10,000; $R_2$ is alkylene of from two to six carbon atoms; and a is an integer of from zero to ten; and (c) at least 4,800 ppm by weight of a mineral carrier fluid, wherein the weight ratio of mineral carrier fluid to detergent is at least 4:1.

7. The method according to claim 6, wherein the detergent is present at a concentration of at least 2,000 ppm by weight.

8. The method according to claim 6, wherein $R_1$ is a hydrocarbyl group having an average molecular weight of from about 1,000 to 10,000.

9. The method according to claim 1, wherein $R_2$ is alkylene of from two to three carbon atoms.

10. The method according to claim 1, wherein a is an integer of from one to six.

* * * * *